US007438387B2

(12) United States Patent
Shimizu et al.

(10) Patent No.: US 7,438,387 B2
(45) Date of Patent: Oct. 21, 2008

(54) INK-JET RECORDING APPARATUS AND METHOD OF PREVENTING CLOGGING OF NOZZLE DISCHARGING INK

(75) Inventors: Megumi Shimizu, Mishima (JP); Takahisa Ikeda, Mishima (JP); Kouichi Adachi, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/766,392

(22) Filed: Jun. 21, 2007

(65) Prior Publication Data

US 2008/0030546 A1 Feb. 7, 2008

Related U.S. Application Data

(63) Continuation of application No. 10/968,728, filed on Oct. 19, 2004, now Pat. No. 7,249,827.

(30) Foreign Application Priority Data

Feb. 10, 2004 (JP) ..... 2004-033857

(51) Int. Cl.
*B41J 2/14* (2006.01)
*B41J 2/16* (2006.01)
*B41J 2/165* (2006.01)

(52) U.S. Cl. ..... 347/47; 347/22

(58) Field of Classification Search ..... 347/22, 347/23, 35
See application file for complete search history.

(56) References Cited

U.S. PATENT DOCUMENTS

| | | | |
|---|---|---|---|
| 6,193,354 | B1 | 2/2001 | Ito |
| 6,378,973 | B1 | 4/2002 | Kubota et al. |
| 2002/0041315 | A1 | 4/2002 | Kubota et al. |

FOREIGN PATENT DOCUMENTS

| | | | |
|---|---|---|---|
| EP | 0 872 346 | A1 | 10/1998 |
| JP | 05-293962 | A | 11/1993 |
| JP | 11-342630 | | 12/1999 |
| JP | 2000-168103 | A | 6/2000 |
| JP | 2003-136744 | | 5/2003 |
| JP | 2003-341029 | | 12/2003 |

*Primary Examiner*—Matthew Luu
*Assistant Examiner*—Lisa M Solomon
(74) *Attorney, Agent, or Firm*—Frishauf, Holtz, Goodman & Chick, P.C.

(57) ABSTRACT

An ink-jet recording apparatus is provided which includes an ink-jet head having a plurality of ink chambers and a common ink chamber which communicates with each of the plurality of ink chambers to supply ink to the plurality of ink chambers, the ink-jet head maintaining the plurality of ink chambers at a negative pressure in image recording, selecting one of the plurality of ink chambers on the basis of printing data and causing change in volume of the selected ink chamber, and thereby performing image recording by discharging the ink from a nozzle, and a pressure section which applies a positive pressure to the plurality of ink chambers when the ink-jet head is in a left state, the positive pressure being a pressure at which the ink is not discharged from the nozzle.

6 Claims, 8 Drawing Sheets

INK-JET RECORDING APPARATUS AND METHOD OF PREVENTING CLOGGING OF NOZZLE DISCHARGING INK

CROSS-REFERENCE TO RELATED APPLICATIONS

The present application is a Continuation Application of U.S. application Ser. No. 10/968,728 filed Oct. 19, 2004, now U.S. Pat. No. 7,249,827 which is based upon and claims the benefit of priority from the prior Japanese Patent Application No. 2004-033857, filed Feb. 10, 2004, the entire contents of which are incorporated herein by reference.

BACKGROUND OF THE INVENTION

1. Field of the Invention

The present invention relates to an ink-jet recording apparatus which records an image on a recording medium, and a method of preventing clogging of nozzles which discharge ink of ink-jet heads mounted on the ink-jet recording apparatus.

2. Description of the Related Art

As ink-jet recording apparatus, known is an on-demand ink-jet printer. This ink-jet printer comprises an ink-jet head having nozzles for discharging ink and ink chambers for storing ink. The ink-jet printer discharges ink from the nozzles by changing the volume of the ink chambers, and forms an image on a recording medium. As controlling methods of providing change in volume in the ink chambers, there are a piezoelectric controlling method utilizing distortion of a piezoelectric member, and a control method using a heating element. It is possible to perform on-demand printing by providing change in volume to each ink chamber by the above controlling methods. In such conventional ink-jet printers, negative pressure is always applied to the ink chambers and the nozzles, such that the ink surface (meniscus) is formed on the reverse side of the ink discharging direction. This is performed to prevent leakage of ink from the nozzles other than when necessary, such as recording, and prevent soiling a medium such as paper by discharging ink only when necessary.

However, when the ink-jet head is left for a long time in the state where negative pressure is applied to the ink chambers and the nozzles, if air bubbles or waste adhere to the nozzles, they easily enter the nozzles by the influence of vibration and the like. Further, when the ink-jet head is left for a long time, moisture and volatile components evaporate from the ink in the nozzles. In particular, it causes a local increase in viscosity in edge portion of the ink surface (meniscus), and causes condensation of color material of ink. Thereby, performing recording operation after leaving the ink-jet head for a long time causes non-discharge or discharge failure of ink.

BRIEF SUMMARY OF THE INVENTION

The object of the present invention is to provide an ink-jet recording apparatus and method of preventing clogging of nozzle jetting ink, which can prevent decrease in recording quality, such as non-discharge and discharge failure in recording, and maintain recording quality, by leaving ink chambers and nozzles with positive pressure applied thereon when the ink-jet head is left for a long time.

According to an embodiment of the present invention, an ink-jet recording apparatus comprises:

an ink-jet head having a plurality of ink chambers and a common ink chamber which communicates with each of the plurality of ink chambers to supply ink to the plurality of ink chambers, the ink-jet head maintaining the plurality of ink chambers at a negative pressure in image recording, selecting one of the plurality of ink chambers on the basis of printing data and causing change in volume of the selected ink chamber, and thereby performing image recording by discharging the ink from a nozzle; and a pressure section which applies a positive pressure to the plurality of ink chambers when the ink-jet head is in a left state, the positive pressure being a pressure at which the ink is not discharged from the nozzle.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to drawings.

First Embodiment

Figure 1:
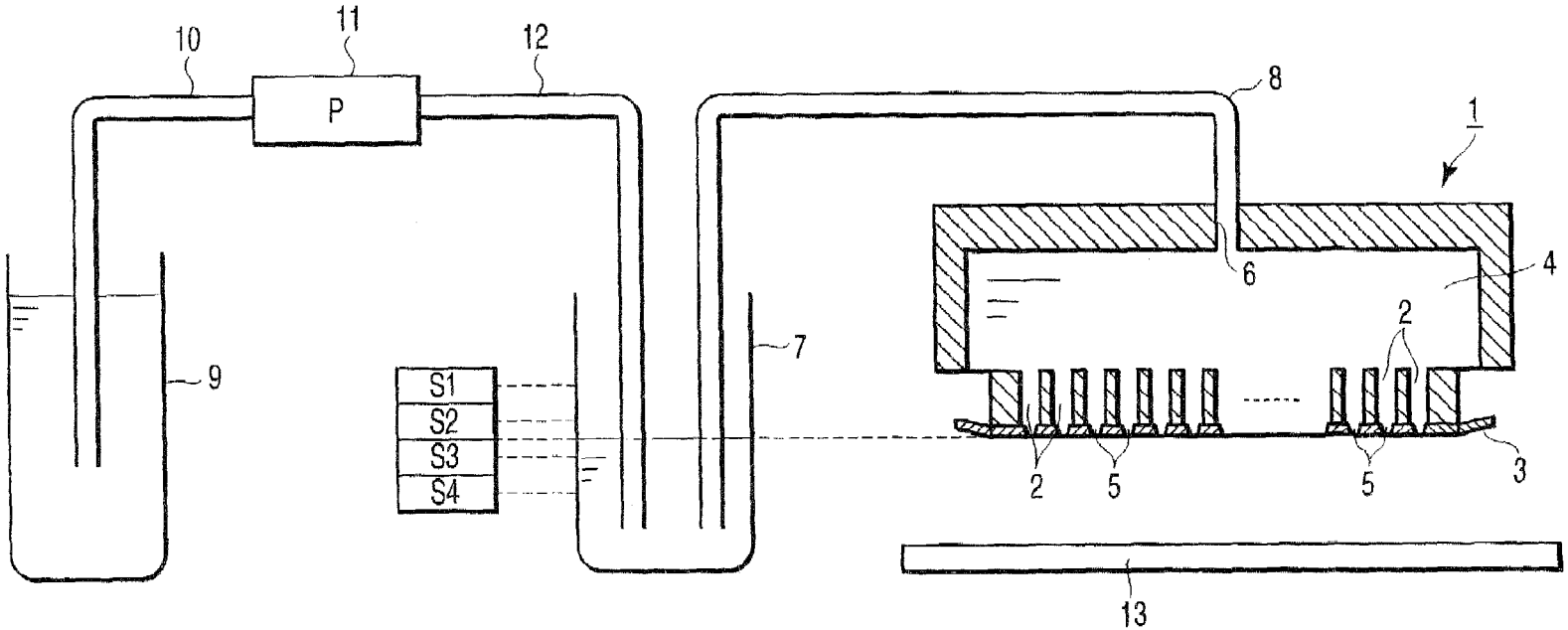
FIG. 1 is a diagram illustrating a schematic structure of an ink-jet head according to a first embodiment of the present invention.

FIG. 1 is a diagram schematically illustrating a structure of an ink-jet head 1. As shown in FIG. 1, the ink-jet head 1 has a structure in which a plurality of ink chambers 2 are arranged in a line, an orifice plate 3 is disposed on a front surface of each ink chamber 2, and a common ink chamber 4 is disposed behind the ink chambers 2. A nozzle 5 is provided in each of the orifice plates 3 by boring the orifice plate 3. The nozzles 5 correspond to respective ink chambers 2, and the diameter of each nozzle 5 is gradually reduced toward the outside. An ink supply port 6 for supplying ink from the outside to the common ink chamber 4 is provided on the side of the common ink chamber 4 opposite to the ink chambers. The ink-jet head 1 is configured to discharge ink from the nozzles 5 by generating change in volume of the ink chambers 2 according to a drive signal provided from a head drive section 34 described later.

An ink tank 7 for supplying ink to the ink-jet head 1 is disposed in a predetermined position distant from the ink jet head 1. The ink tank 7 is disposed such that a line extended from the ink discharging surface of the ink-jet head 1 is located on a side surface of the ink tank 7. Ink is supplied from the ink tank 7 to the ink-jet head 1 through a conduit member 8. The conduit member 8 is disposed such that its end on the ink-jet head 1 side is connected to the ink supply port 6 and its end on the ink tank 7 side is located in the ink in the ink tank 7. Further, in the vicinity of the ink tank 7, sensors S1 to S4 for sensing the ink in the ink tank 7 are arranged in different positions along the vertical direction. The four sensors S1 to S4 are arranged in the order of sensor S1, sensor S2, sensor S3 and sensor S4 from the upper side of the ink tank 7. The sensors S1 and S2 are arranged to be higher than the ink discharging surface of the ink jet head 1. The sensor S1 is used to sense the upper limit of the positive pressure to be applied to each ink chamber 2 and each nozzle 5, and the sensor S2 is used to sense the lower limit of the positive pressure to be applied to each ink chamber 2. Specifically, the sensor S1 is disposed in a position preventing occurring of leakage of ink from each ink chamber 2 (a position slightly lower than a position of the ink liquid surface where the ink actually leaks), and the sensor S2 is disposed in a lower limit position in which positive pressure can be applied to each ink chamber 2. The sensors S3 and S4 are arranged to be lower than the ink discharging surface of the ink-jet head 1. The sensor S3 is used to sense the lower limit of the negative pressure to be applied to each ink chamber 2, and the sensor S4 is used to sense the upper limit of the negative pressure to be applied to each ink chamber 2. If the ink liquid surface of the ink tank 7 is maintained in this range in image recording, the ink-jet head 1 can perform good ink discharge. Each of the sensors S1 to S4 outputs a signal indicating "ON" when it senses the ink in the ink tank 7, and outputs a signal indicating "OFF" when it does not sense the ink in the ink tank 7.

Another ink tank 9 stores a large quantity of ink. Ink is supplied from the ink tank 9 to the ink tank 7 through a conduit member 10, a pump 11 and a conduit member 12. One end of the conduit member 10 is located in the ink in the ink tank 9, and the other end is connected to the pump 11. One end of the conduit member 12 is connected to the pump 11, and the other end is located in the ink in the ink tank 7. The pump 11 can be operated in forward and reverse directions. When the pump 11 is operated in the forward direction, the pump 11 supplies ink from the ink tank 9 to the ink tank 7 through the conduit members 10 and 12. When the pump 11 is operated in the reverse direction, the pump 11 sucks ink from the ink tank 7 to the ink tank 9 through the conduit members 12 and 10. Therefore, the ink liquid surface of the ink tank 7 can be adjusted by operation of the pump 11.

Further, an ink receiver 13 for receiving ink leaking from the nozzles 5 can be provided on the ink discharging side of the ink-jet head 1. The ink receiver is moved between a position for receiving ink and a receded position (not shown).

The ink-jet head 1 structured as described above is supported by a head supporting mechanism (not shown), and provided in an ink-jet recording apparatus 100. Paper is carried in the direction vertical to the surface of the drawing with the ink-jet head 1 fixed, and recording is performed. Further, to simplify the explanation, although FIG. 1 illustrates the case where one ink-jet head 1 is provided, a long head formed by aligning a plurality of ink-jet heads 1 may be adopted as a matter of course.

Figure 2:
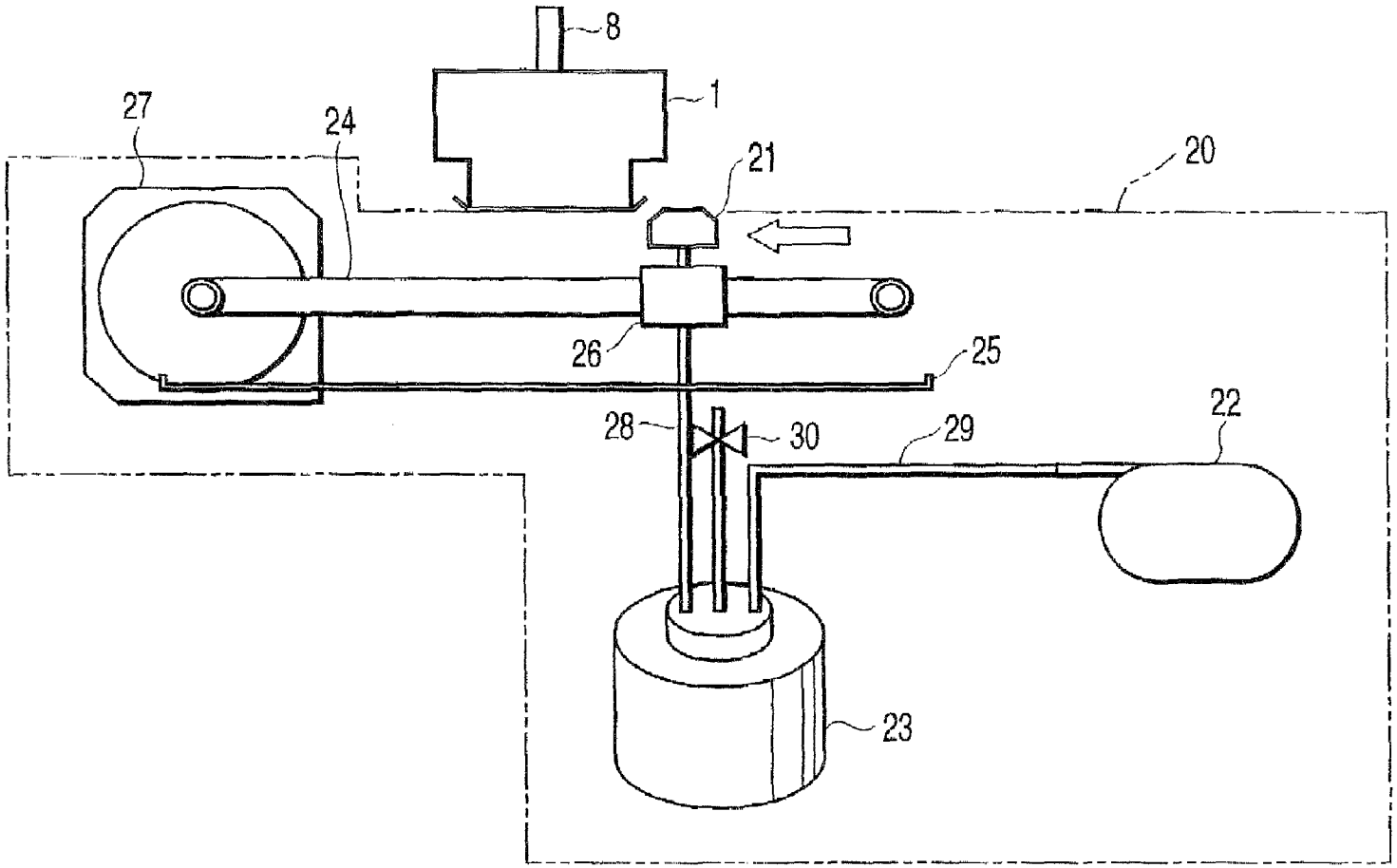
FIG. 2 is a diagram illustrating a schematic structure of a maintenance device according to the first embodiment.

FIG. 2 is a diagram illustrating a maintenance device 20 for performing maintenance of the above ink-jet head 1. The maintenance device 20 comprises a suction nozzle 21 for sucking ink, a suction pump 22, and an ink recovery tank 23 for storing the sucked ink. The suction nozzle 21 of the maintenance device 20 and a suction nozzle drive section 24 are mounted on a stage 25 of the maintenance device 20. The suction nozzle 21 is positioned by a support member 26 such that the suction nozzle 21 abuts against the ink discharging side of the ink-jet head 1 when it moves on the stage 25. The support member 26 is fixed onto the suction nozzle drive section 24. The suction nozzle 21 achieves a mechanism that it moves along the arranging direction of the nozzles 5 of the ink-jet head 1, by driving a suction nozzle drive motor 27 and moving the suction nozzle drive section 24. A conduit member 28 which communicates with the suction nozzle 21 communicates, at the other end, with the ink recovery tank 23. The ink recovery tank 23 communicates with a conduit member 29. The other end of the conduit member 29 communicates with the suction pump 22. The end of the conduit member 29 on the ink recovery tank 23 side is located in a position in the ink recovery tank 23, in which the end does not contact the ink liquid surface between the ink and the air. The ink recovery tank 23 is provided with a pressure regulating valve 30 for regulating the pressure under which ink is sucked through the conduit member 28 communicating with the suction nozzle 21.

Figure 3:
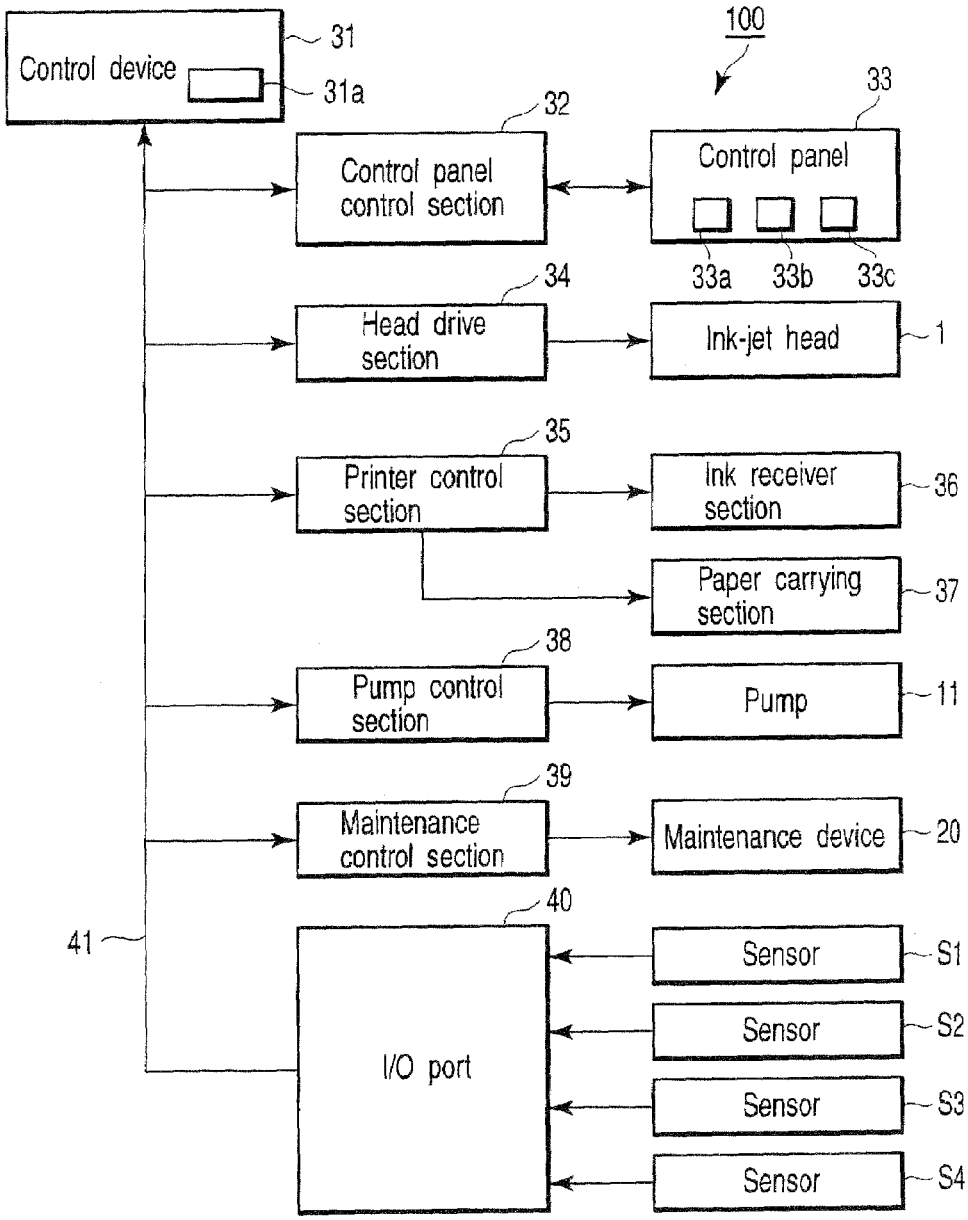
FIG. 3 is a block diagram illustrating a schematic control structure of an ink-jet recording apparatus of the first embodiment.

FIG. 3 is a block diagram illustrating a schematic control structure of the ink-jet recording apparatus 100 having the above structure. The ink-jet recording apparatus 100 comprises a control device 31, a control panel control section 32, a control panel 33, a head drive section 34, the ink-jet head 1, a printer control section 35, an ink receiver section 36, a paper carrying section 37, a pump control section 38, the pump 11, a maintenance control section 39, the maintenance device 20, an I/O port 40 and the sensors S1 to S4. The control device 31 is connected to the control panel control section 32, the head drive section 34, the printer control section 35, the pump control section 38, the maintenance control section 39 and the I/O port 40 via a bus line 41.

The control device 31 comprises a microprocessor, and a memory and the like. The control device 31 executes a control program stored in the memory, and thereby performs overall control of the control panel control section 32, the head drive section 34, the printer control section 35, the pump control section 38 and the maintenance control section 39. The control device 31 also has a clock section 31*a* inside, which generates clocks, and can perform clocking based on the clocks generated by the clock section 31*a*.

The control panel 33 has a display section which display information necessary to the user, and an operation section for receiving instructions from the user. The control panel control section 32 controls display on the display section of the control panel 33, and transmits the user's instructions received from the operation section to the control device 31. The operation section is provided with various switches and keys, such as a leaving preparation switch 33*a*, a recording preparation switch 33*b* and a recording switch 33*c*. The leaving preparation switch 33*a* is a switch for setting the ink-jet recording apparatus 100 left if the user does not perform image recording for a long time. The recording preparation switch 33*b* is a switch for instructing the ink-jet recording apparatus 100 in the left state to prepare image recording. The recording switch 33*c* is a switch for instructing the ink-jet recording apparatus 100 to start image recording.

The head drive section 34 selects one ink chamber 2 to discharge ink from the ink chambers 2 on the basis of predetermined printing data, and provides the selected ink chamber 2 with a drive signal for causing a change in volume of the selected ink chamber 2 to allow the nozzle 5 thereof to discharge ink. The printing data may be received from an external apparatus via an interface (not shown), for example. If the ink-jet recording apparatus 100 is realized as a multifunction machine having a scanner function, the printing data may be based on image data read by the scanner.

The printer control section 35 controls movement of the ink receiver 13 by the ink receiver section 36, and paper carrying operation of the paper carrying section 37. For example, when the leaving preparation switch 33*a* is turned on, the printer control section 35 moves the ink receiver 13 from its receded position to a position below the ink discharging surface of the ink-jet head 1, to prevent contamination of the inside of the ink-jet recording apparatus 100 by leakage of ink from the nozzles 5. In image recording, the printer control section 35 moves the ink receiver 13 to the receded position. The paper carrying section 37 carries paper stored in a paper feed cassette (not shown) or the like one by one below the ink-jet head 1 at predetermined speed, and thereafter ejects the paper to the outside.

The pump control section 38 controls forward and reverse operation of the pump 11, and supplies or sucks ink to (or from) the ink tank 7. As described above, when the pump control section operates the pump 11 in the forward direction, the pump 11 supplies ink to the ink tank 7. When the pump control section operates the pump 11 in the reverse direction, the pump 11 sucks ink from the ink tank 7.

The maintenance control section 39 performs control to perform maintenance of the ink-jet head 1 at prescribed timing by controlling each portion of the maintenance device 20 explained with reference to FIG. 2.

ON/OFF signals from the sensors S1 to S4 are input to the I/O port 40. The ON/OFF signals input to the I/O port 40 are input to the control device 31 through the bus line 41.

Figure 4:
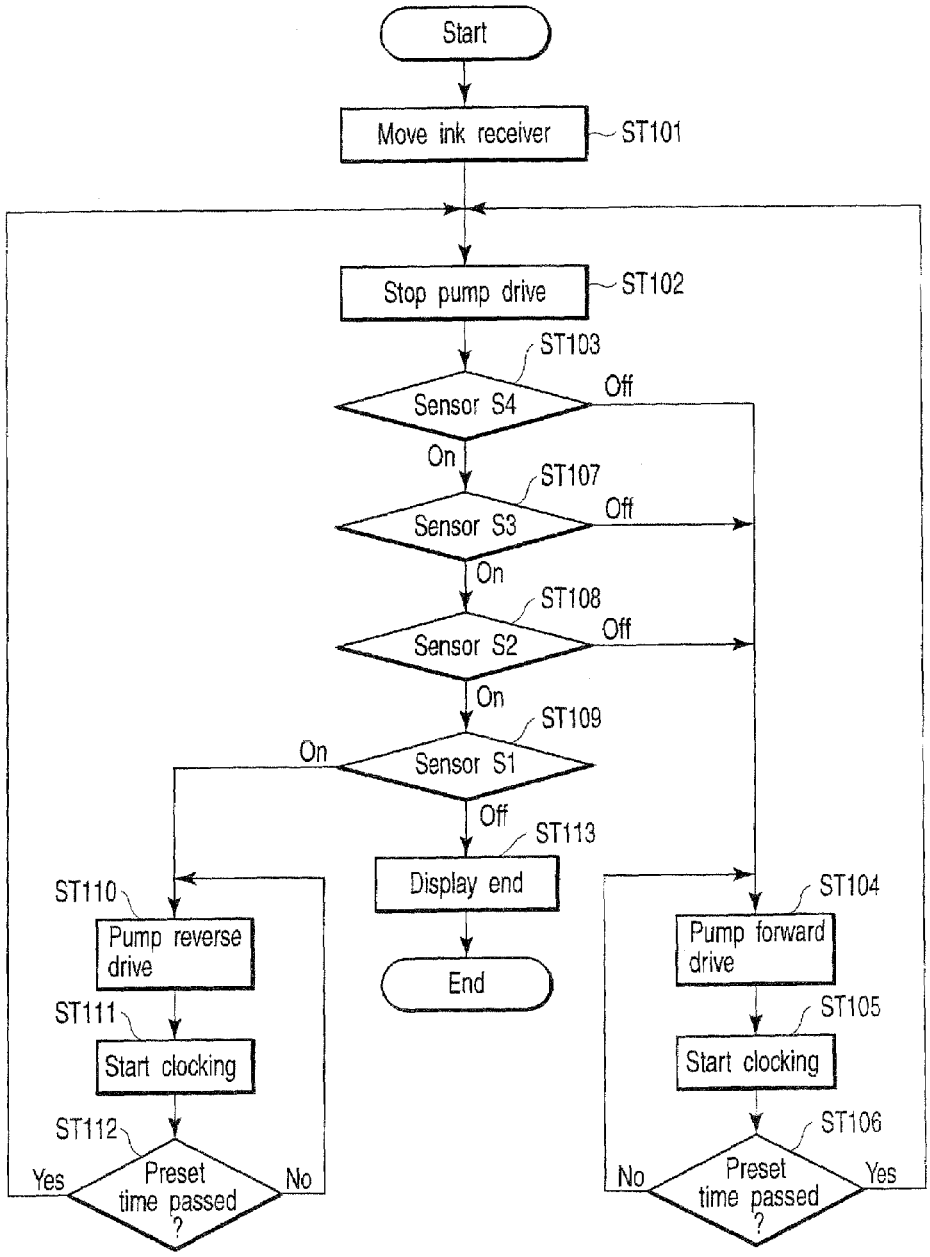
FIG. 4 is a flow chart illustrating leaving preparation operation in the first embodiment.

Next, the leaving preparation processing performed by the control device 31 when the leaving preparation switch 33*a* is turned on is explained with reference to the FIG. 4.

First, the printer control section 35 is controlled to operate the ink receiver section 36 to move the ink receiver 13 to a position below the ink-jet head 1 (ST101). Next, the pump control section 38 is controlled to stop the drive of the pump 11 (ST102). Then, the control device 31 judges whether the sensor S4 is in the ON state or the OFF state, on the basis of the signal of the sensor S4 inputted from the I/O port 40 (ST103). If it judges that the sensor S4 is in the OFF state, the control device 31 controls the pump control section 38 to drive the pump 11 to operate in the forward direction (ST104). When forward drive of the pump 11 is started, the control device 31 starts clocking (ST105). The forward drive of the pump 11 is continued until a preset time elapses. When the preset time elapses (YES of ST106), it returns to the step ST102, and the control device 31 controls the pump control section 38 to stop the drive of the pump 11. The preset time is time for supplying a predetermined quantity of ink to the ink tank 7.

In the meantime, if the control device 31 judges that the sensor S4 is in the ON state in step ST103, the control device 31 judges whether the sensor S3 is in the ON state or in the OFF state, on the basis of the signal of the sensor S3 inputted from the I/O port 40 (ST107). If the control device 31 judges that the sensor S3 is in the OFF state, it goes to the step ST104 to perform processing to supply a predetermined quantity of ink to the ink tank 7 (ST104 to ST106). This processing is continued until sensor S3 is judged as in the ON state.

If the control device 31 judges that the sensor S3 is in the ON state in step ST107, the control device 31 judges whether the sensor S2 is in the ON state or in the OFF state, on the basis of the signal of the sensor S2 inputted from the I/O port 40 (ST108). If the control device 31 judges that the sensor S2 is in the OFF state, it goes to the step ST104 to perform processing to supply a predetermined quantity of ink to the ink tank 7 (ST104 to ST106).

If the control device 31 judges that the sensor S2 is in the ON state in step ST108, the control device 31 judges whether the sensor S1 is in the ON state or in the OFF state, on the basis of the signal of the sensor S1 inputted from the I/O port 40 (ST109). If the control device 31 judges that the sensor S1 is in the ON state, it controls the pump control section 38 to drive the pump 11 in the reverse direction (ST110) When reverse drive of the pump 11 is started, the control device 31 starts clocking (ST111). The control device 31 continues reverse drive of the pump 11 until the preset time elapses. When the control device 31 judges that the preset time has elapsed (YES in ST112) it returns to the step ST102, and controls the pump control section 38 to stop drive of the pump 11. The preset time is time for sucking a predetermined quantity of ink from the ink tank 7. If the control device 31 judges that the sensor S1 in the OFF state in step ST109, the control device 31 controls the control panel control section 32 to display end of processing on the display section of the control panel 33 (ST113), and ends the processing.

By performing this processing, the ink liquid surface of the ink tank 7 can be located between a position in which the sensor S1 senses the ink and a position in which the sensor S2 senses the ink. Therefore, it is possible to apply positive pressure to each ink chamber 2 and each nozzle 5 through the conduit member 8 and the common ink chamber 4.

After the user checks by display on the display section of the control panel 33 that positive pressure has been applied to the ink chambers 2, the user turns off a power switch (not shown) to cut off the power to the ink-jet recording apparatus 100.

Figure 5:
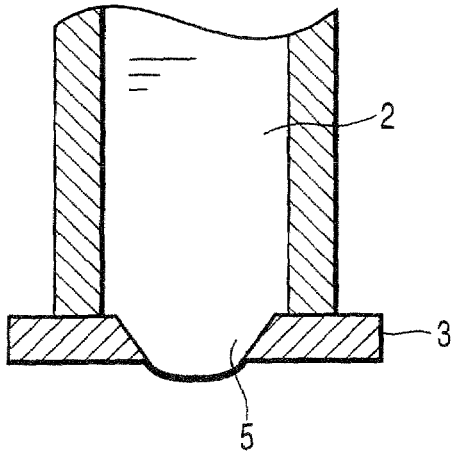
FIG. 5 is a diagram illustrating a part of an ink chamber and a nozzle in a left state in the first embodiment.
Figure 6:
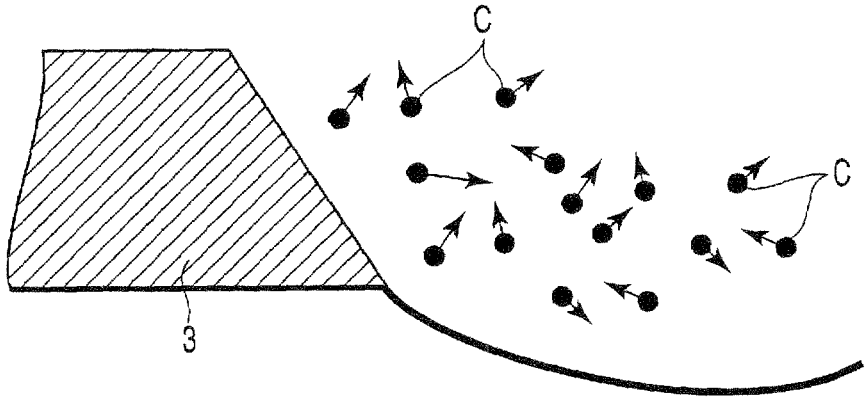
FIG. 6 is a diagram illustrating the vicinity of the nozzle in FIG. 5.

The state of the ink chambers 2 of the ink-jet head 1 when the ink-jet recording apparatus is in the left state after the above processing is explained with reference to FIGS. 5 and 6. FIG. 5 is a diagram illustrating a part of an ink chamber 2 and the vicinity of the nozzle 5 of the ink-jet head 1. FIG. 6 is a diagram illustrating the vicinity of the nozzle 5 shown in FIG. 5. As shown in FIG. 5, the ink surface (meniscus) bulges and projects from the nozzle 5 to the extent not discharging ink drop. Since positive pressure is applied to the ink chamber 2 and the nozzle 5 to achieve this state, it is possible to reduce evaporation of volatile components in the edge portion of the ink surface. This prevents increase in the viscosity of ink in the edge portion of the ink surface, and allows free movement of color material molecules C, as shown in FIG. 6. If the negative pressure is applied thereto such that the ink surface is recessed in the direction reverse to the ink discharging direction, local increase in viscosity occurs in the edge portion of the ink surface, and condensation of the color material of the ink occurs. The ink-jet recording apparatus 100 of this embodiment can prevent these problems by reducing evaporation of volatile components.

Further, when the ink-jet recording apparatus 100 is set to the left state, the ink receiver 13 is located to oppose to the ink discharging side of the ink-jet head 1. Therefore, even when the ink leaks from the nozzles 5 for some reason such as impact from the outside, the ink does not adhere to the inside mechanism or the like, and the medium such as paper is not contaminated in image recording.

Next, explained is the case where the ink-jet recording apparatus 100 in the left state as described above is powered and started to perform image recording. Since the ink-jet recording apparatus 100 is in the left state, it is necessary to perform preparation for recording. The user turns on the recording preparation switch 33*b* provided on the control panel 33 to instruct the ink-jet recording apparatus 100 to perform the preparation for recording.

Figure 7:
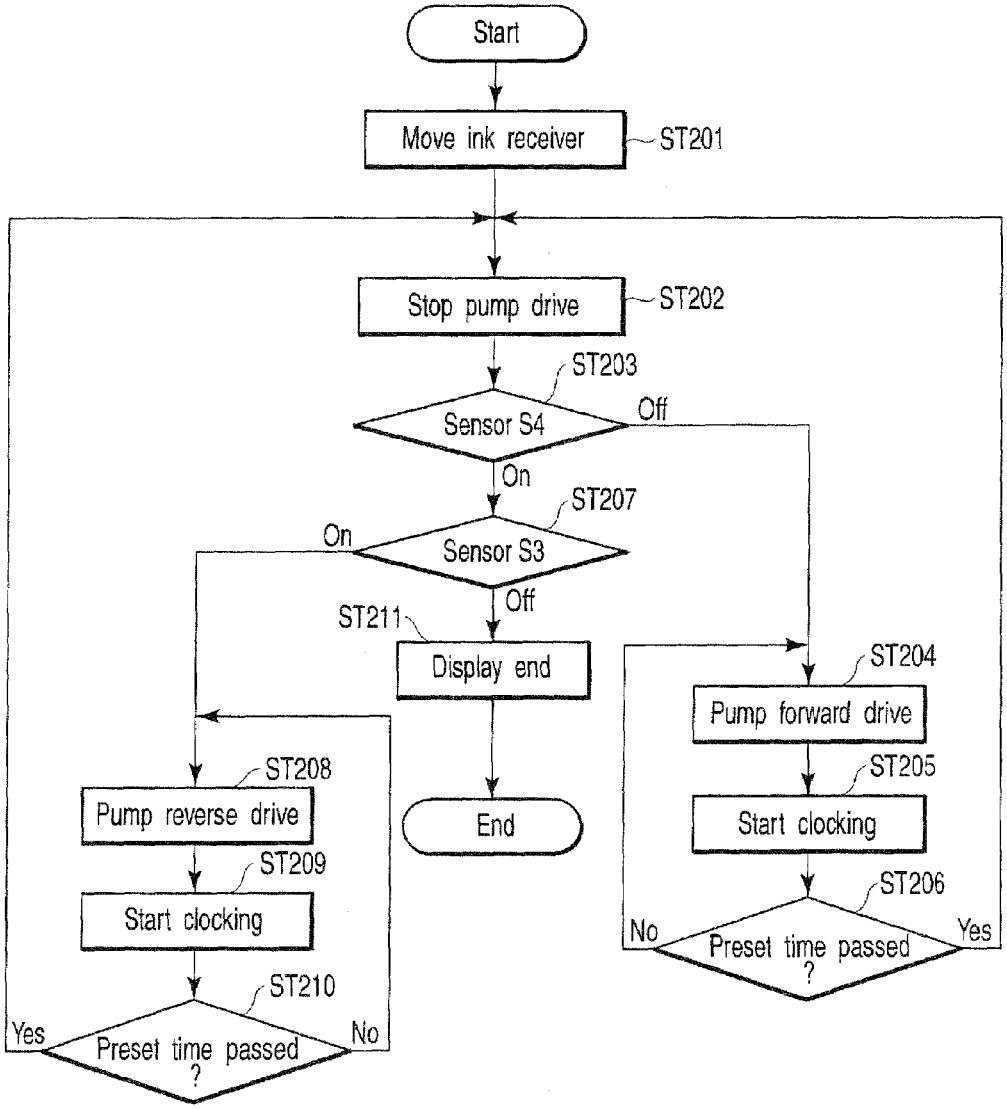
FIG. 7 is a flow chart illustrating recording preparation operation in the first embodiment.

FIG. 7 is a flow chart illustrating recording preparation processing performed by the control device 31 when it detects turn-on of the recording preparation switch 33*b*. The following is explanation of the processing.

First, the control device 31 controls the printer control section 35 to operate the ink receiver section 36 to move the ink receiver 13 from the position below the ink-jet head 1 to the receded position (ST201). Then, the control device 31 controls the pump control section 38 to stop drive of the pump 11 (ST202). When either of the steps ST201 and ST202 is completed, the maintenance control section 39 may be controlled to perform maintenance of the ink-jet head 1.

Then, the control device 31 judges whether the sensor S4 is in the ON state or in the OFF state, on the basis of the signal of the sensor S4 inputted from the I/O port 40 (ST203) If it judges that the sensor S4 is in the OFF state, the control device 31 performs processing to supply ink to the ink tank 7 (ST204 to ST206) until the control device 31 judges that the sensor S4 is in the ON state. This processing is the same as the above processing of steps ST104 to ST106, and detailed explanation thereof is omitted.

In the meantime, if the control device 31 judges that the sensor S4 is in the ON state in step ST203, the control device 31 judges whether the sensor S3 is in the ON state or in the OFF state, on the basis of the signal of the sensor S3 inputted from the I/O port 40 (ST207). If the control device 31 judges that the sensor S3 is in the ON state, the control device performs processing of sucking ink from the ink tank 7 (ST208 to ST209) until sensor S3 is judged as in the OFF state. This processing is the same as the above processing of the steps ST110 to ST112, and detailed explanation thereof is omitted.

If the control device 31 judges that the sensor S3 is in the OFF state in step ST207, the control device 31 controls the control panel control section 32 to display end of processing on the display section of the control panel 33 (ST211), and ends the processing.

By performing this processing, the ink liquid surface of the ink tank 7 can be located between a position in which the sensor S3 senses the ink and a position in which the sensor S4 senses the ink. Therefore, it is possible to apply negative pressure to each ink chamber 2 and each nozzle 5 of the ink-jet head 1. As described above, the pressure to be applied to each ink chamber 2 and ink becomes negative, and thus good image recording is possible.

Further, when image recording preparation is performed, the control device 31 judges the ON/OFF state of the sensor S4 before judging the ON/OFF state of the sensor S3. Therefore, the device 31 can deal with the case where the position of the ink liquid surface of the ink tank 7 has changed to be lower than the position in which the sensor S4 senses the ink due to exchange of the ink tank 7 while the recording apparatus 100 is in the left state.

Figure 8:
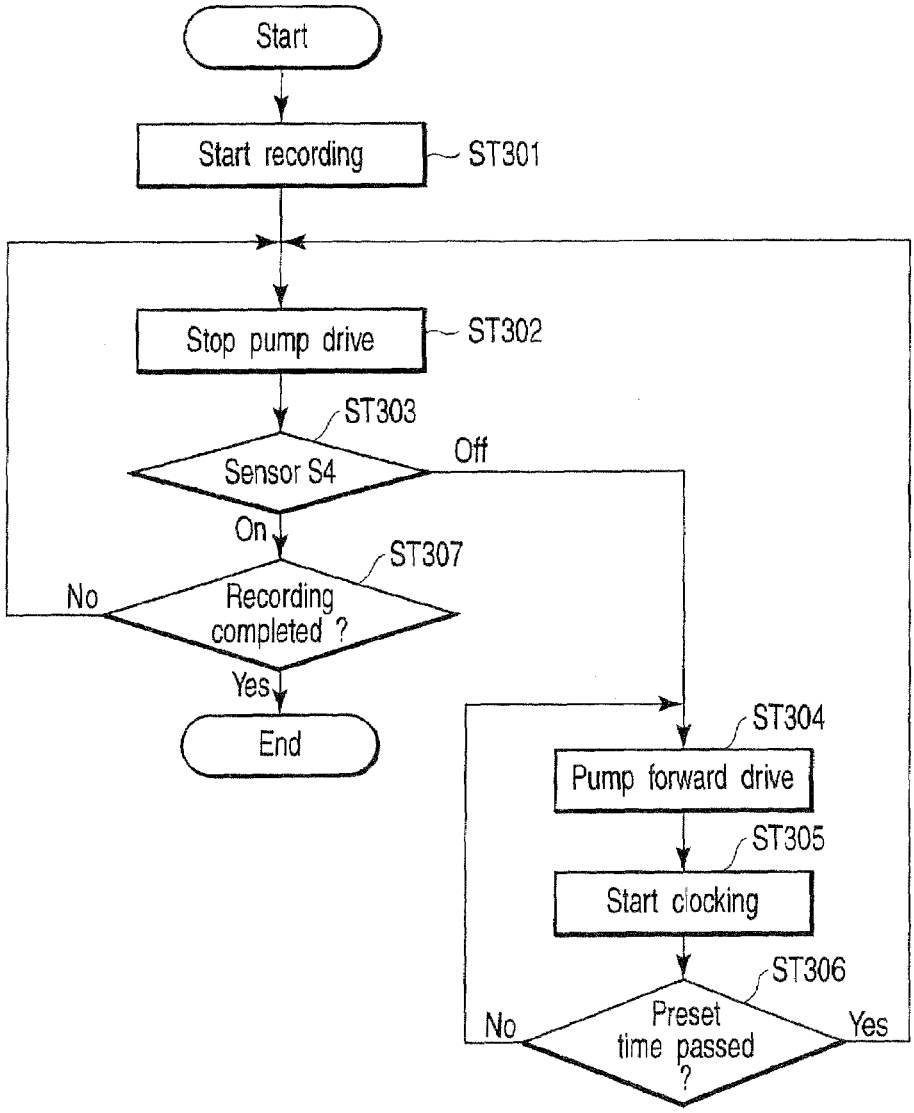
FIG. 8 is a flow chart illustrating operation of maintaining ink chambers and nozzles at negative pressure in the first embodiment.

When the recording switch 33*c* is turned on and image recording is being performed, ink is discharged from the ink-jet head 1, and the ink liquid surface of the ink tank 7 lowers. Therefore, as shown in the flow chart of FIG. 8, the control device 31 performs processing for maintaining the ink chambers 2 and the nozzles 5 at a proper negative pressure.

When image recording is started (ST301), the control device 31 controls the pump control section 38 to stop drive of the pump 11 (ST302). Then, the control device 31 judges whether the sensor S4 is in the ON state or in the OFF state on the basis of the signal from the sensor S4 inputted from the I/O port 40 (ST303). If it judges that the sensor S4 is in the OFF state, the control device 31 performs processing of supplying ink to the ink tank 7 (steps ST304 to ST306) until it judges that the sensor S4 is in the ON state. This processing is the same as the processing of the steps ST104 to ST106, and detailed explanation thereof is omitted. In the meantime, if it judges that the sensor S4 is in the ON state, the control device 31 judges whether image recording has been completed or not (ST307). If the control device 31 judges that image recording has not been completed, it returns to the step ST303. If the control device 31 judges that image recording has been completed, the control device 31 ends the processing.

By performing this processing, the ink liquid surface of the ink tank 7 can be located to be higher than the position where the sensor S4 senses the ink, thus it is possible to prevent the ink liquid surface from being lower than the ink-sensing position by the sensor S4 due to consumption of ink during image recording. Therefore, the pressure to be applied to each ink chamber 2 and each nozzle 5 during image recording can be always maintained at a proper negative pressure, and thereby good recording is achieved.

According to the ink-jet recording apparatus 100 of the first embodiment, when the ink-jet head 1 is left, the pressure applied to the ink chambers 2 and the nozzles 5 is changed to positive pressure. Thereby, even if air bubbles and waste adhere to the ink surface, they do not easily enter the nozzles 5, and thus non-discharge and discharge failure are prevented.

Further, since the apparatus 100 can reduce volatilization of volatile components in the edge portion of the ink surface, movement of the color material particles C is not restrained, that is, the viscosity thereof does not increase. Therefore, it is possible to reduce occurrence of non-discharge of ink.

Second Embodiment

Next, a second embodiment of the present invention is explained. The same constituent elements as those in the above embodiment are denoted by the same respective reference numerals, and detailed explanation thereof is omitted. An ink-jet recording apparatus 100 of this embodiment has a structure of changing each ink chamber 2 and each nozzle 5 to positive pressure by moving the ink-jet head 1 while the liquid surface of the ink stored in the ink tank 7 is maintained within a certain range.

Figure 9:
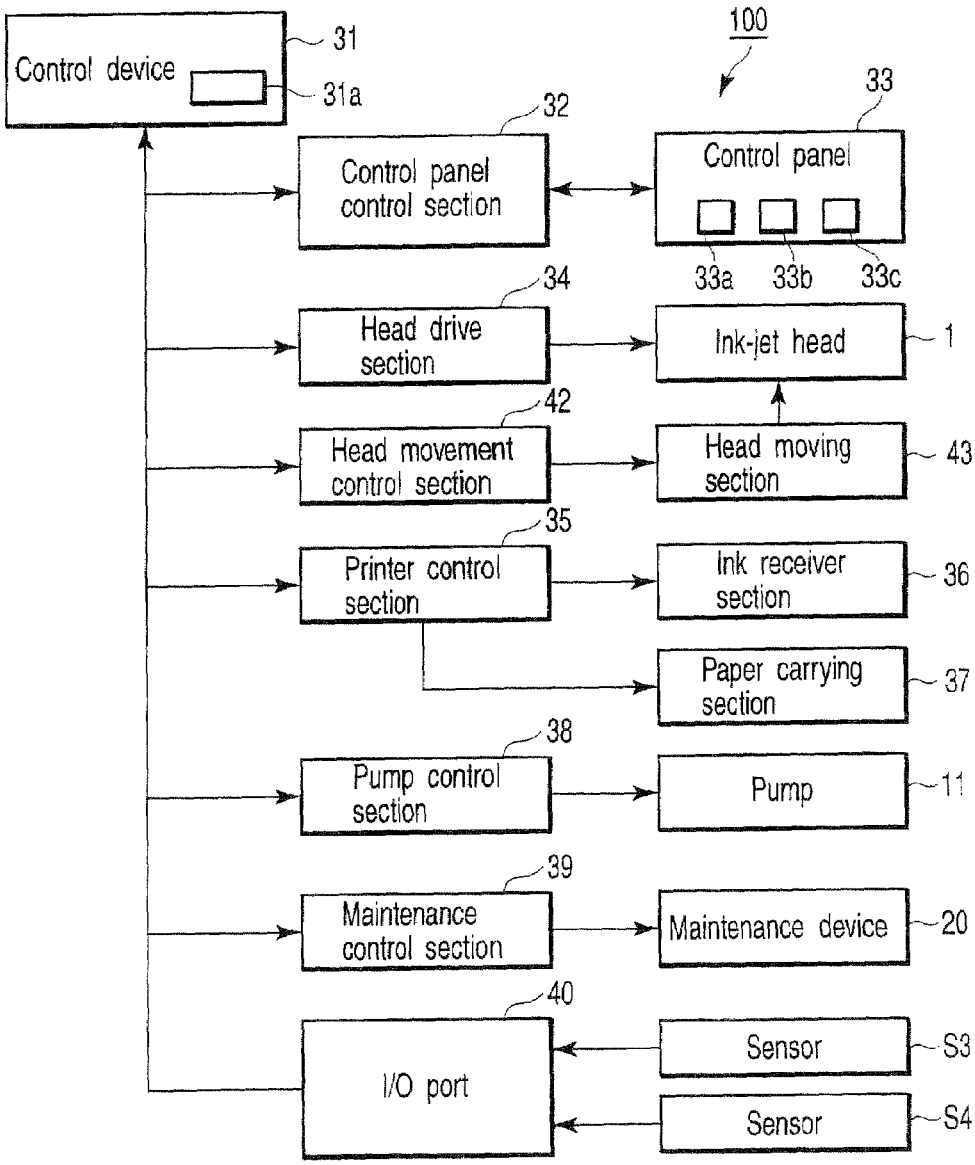
FIG. 9 is a diagram illustrating a schematic structure of an ink-jet head according to a second embodiment of the present invention.

FIG. 9 is a block diagram illustrating a schematic control structure of the ink-jet recording apparatus 100 of the second embodiment. As shown in FIG. 9, the apparatus 100 has a head movement control section 42 for controlling a head moving section 43 which moves the ink-jet head 1, and sensors for sensing ink in the ink tank 7 are constituted by two sensors S3 and S4.

When a leaving preparation switch 33*a* is turned on, the control device 31 controls, by using ON/OFF signals of the sensors S3 and S4, a pump control section 38 to move the pump 11 to dispose the ink liquid surface between a position where the sensor S3 senses ink and a position where the sensor S4 senses ink.

Further, the control device 31 controls the head movement control section 42 to operate the head moving section 43 to vertically move the ink-jet head 1 with respect to the ink liquid surface which is maintained within a predetermined range in the ink tank 7, such that positive pressure is applied to each ink chamber 2 and each nozzle 5 of the ink-jet head 1 when the ink-jet head 1 is left for a long time. The movement of the ink-jet head 1 is achieved by fixing the mechanism for sucking the ink-jet head 1 by a suction nozzle 21, and moving the ink-jet head 1 vertically with respect to the fixed maintenance position, for example. It is not limited to a structure of moving the ink-jet head 1. It suffices that the ink-jet head 1 and the ink liquid surface of the ink tank 7 are relatively moved such that positive pressure can be applied to the ink chambers 2 and the nozzles 5. Therefore, various structures can be adopted, such as a structure of vertically moving the ink tank 7.

In the above embodiments, explained is the case where the ink-jet recording apparatus 100 performs leaving preparation when the leaving preparation switch 33*a* is turned on. However, the apparatus 100 may have a structure in which the leaving preparation processing is performed when the control device 31 detects elapse of a predetermined time from the time of the last image recording.

Further, the above embodiments have the structure of detecting the ink liquid surface in the ink tank 7 by using sensors. However, the apparatus may have a structure in which weights of the ink when the ink liquid surface is in respective positions corresponding to the sensors S1 to S4 are obtained in advance, a weighing section, such as scales, for weighing ink in the ink tank 7 is provided below the ink tank 7, and ink supply and suction by the pump 11 are controlled by using the weight obtained by the weighing section.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink-jet recording apparatus comprising:

an ink-jet head which includes a plurality of ink chambers corresponding to a plurality of nozzles for discharging ink, and a common ink chamber which communicates with each of the plurality of ink chambers to supply the ink to the plurality of ink chambers, said ink-jet head performing image recording by selecting one of the plurality of ink chambers based on printing data and causing a change in volume of the selected ink chamber to discharge the ink from the nozzle corresponding to the selected ink chamber;

an ink tank which supplies the ink to the plurality of ink chambers via the common ink chamber; and a pressure section which controls a pressure in the plurality of ink chambers;

wherein the pressure section maintains a negative pressure in the plurality of ink chambers during image recording, and the pressure section applies a positive pressure to the plurality of ink chambers when the ink-jet head is in a left state, wherein the positive pressure is a pressure at which the ink is not discharged from the nozzles; and wherein the left state is initiated when a leaving preparation switch is turned on before turning off a power switch, an ink receiver is positioned below the ink-jet head in the left state, and the ink-jet head is not covered with a cap in the left state.

2. An ink-jet recording apparatus according to claim 1, further comprising:

an ink quantity adjusting section which adjusts a quantity of the ink in the ink tank;

wherein the pressure section controls the ink quantity adjusting section to apply the positive pressure to the plurality of ink chambers.

3. An ink-jet recording apparatus according to claim 1, wherein the pressure section controls relative positions of the ink tank and the ink-jet head to apply the positive pressure to the plurality of ink chambers.

4. A method for an ink-jet recording apparatus, wherein the ink-jet recording apparatus comprises an ink-jet head which includes a plurality of ink chambers corresponding to a plurality of nozzles for discharging ink, and a common ink chamber which communicates with each of the plurality of ink chambers to supply the ink to the plurality of ink chambers, wherein image recording is performed by selecting one of the plurality of ink chambers based on printing data and causing a change in volume of the selected ink chamber to discharge ink from the nozzle corresponding to the selected ink chamber, and wherein the plurality of ink chambers are maintained at a negative pressure during image recording, the method comprising:

setting the ink-jet head to a left state by turning on a leaving preparation switch before turning off a power switch, wherein the ink-jet head is not covered by a cap in the left state;

positioning an ink receiver below the ink-jet head in the left state; and applying a positive pressure to the plurality of ink chambers when the ink-jet head is in the left state, wherein the positive pressure is a pressure at which the ink is not discharged from the nozzles.

5. A method according to claim 4, wherein the positive pressure is applied by adjusting a quantity of ink in an ink tank which supplies the ink to the plurality of ink chambers via the common ink chamber.

6. A method according to claim 4, wherein the positive pressure is applied by relatively positioning the ink-jet head and an ink tank, which supplies the ink to the plurality of ink chambers via the common ink chamber.

* * * * *